US005174393A

United States Patent [19]

Roberts et al.

[11] Patent Number: 5,174,393

[45] Date of Patent: Dec. 29, 1992

[54] HYDRAULIC JAR

[75] Inventors: Billy J. Roberts; Elmer J. Volmert; Arthur W. Meeks, all of Houston, Tex.

[73] Assignee: Houston Engineers, Inc., Houston, Tex.

[21] Appl. No.: 724,810

[22] Filed: Jul. 2, 1991

[51] Int. Cl.[5] ..... E21B 31/113

[52] U.S. Cl. ..... 175/297; 166/178

[58] Field of Search ..... 175/296, 297304; 166/178

[56] References Cited

U.S. PATENT DOCUMENTS

Re. 23,354 4/1951 Storm ..... 255/27

2,659,576 11/1953 Linney ..... 255/27

4,109,736 8/1978 Webb et al. ..... 175/297

4,361,195 11/1982 Evans ..... 175/297

4,456,081 6/1984 Newman ..... 175/297

5,033,557 7/1991 Askew ..... 175/297

*Primary Examiner*—William P. Neuder

*Attorney, Agent, or Firm*—Vaden, Eickenroht, Thompson, Boulware & Feather

[57] ABSTRACT

There are disclosed alternate embodiments of a double acting hydraulic jar having a single detent chamber having a restriction on the inner diameter of its outer tubular member through which detent means carried about the outer diameter of the inner tubular member may be moved in order to impart either an up or down jar.

11 Claims, 7 Drawing Sheets

FIG. 10
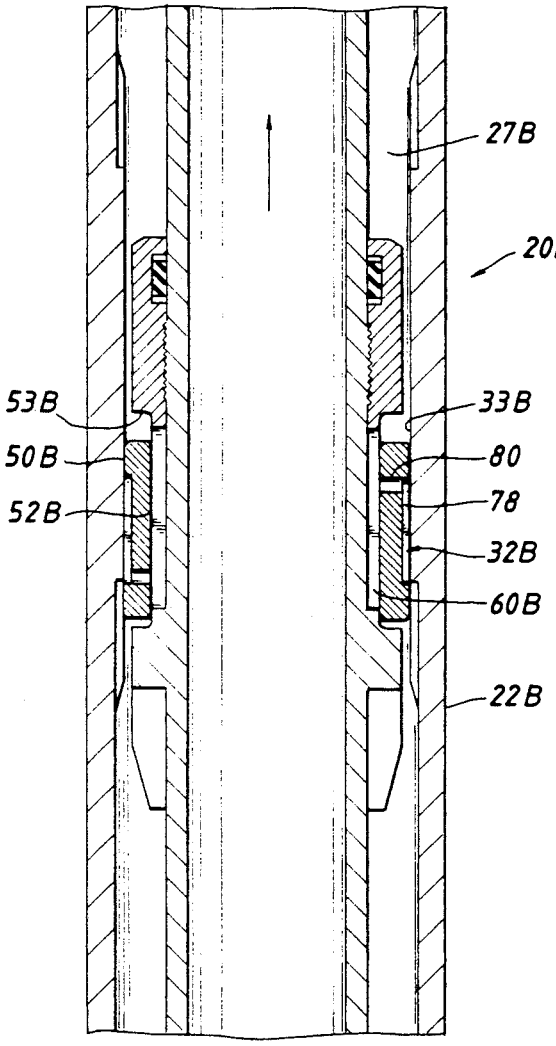
FIG. 11
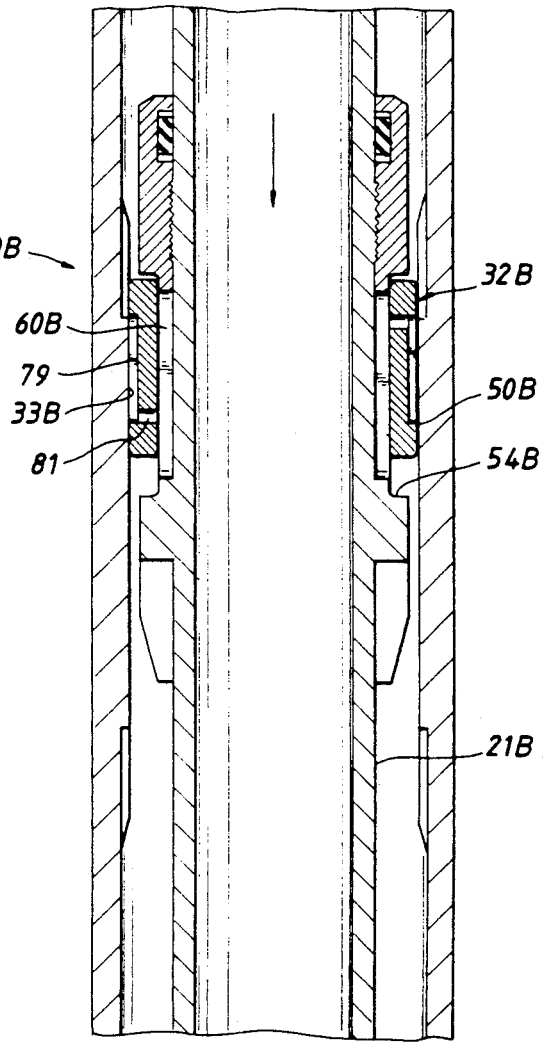
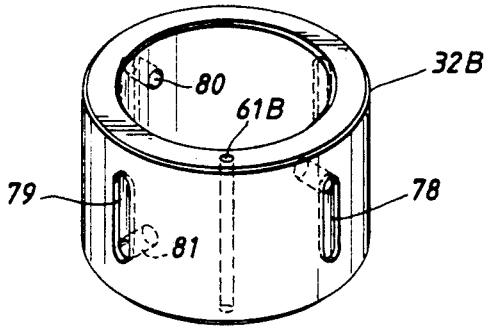
FIG. 12

HYDRAULIC JAR

This invention relates generally to a tool for use in imparting a jar to an object stuck in a well bore, and, more particularly, to improvements in a so-called double acting hydraulic jar for imparting up and down jars to the object.

As well known in the art, a jar of this general type comprises a pair of telescopically arranged, tubular members, one for connection to the object and the other to a pipe string which may be raised and lowered within the well bore. More particularly, the members are circumferentially spaced apart to form an annular space between them with one member having a cylindrical surface which forms a restriction within the space and the other carrying detent means of such construction as to fit closely within the restriction so as to retard its movement therethrough and thus stretch the pipe string as it is raised, in the case of an up jar, or retard its movement therethrough and thus compress the pipe string as it is lowered, in the case of the down jar. The tubular members also have oppositely facing shoulders which are adapted to engage as the detent means moves out of the restriction so as to impart a jar to the object in the desired direction.

More particularly, the outer member is ported to connect the annulus with the well bore, and a piston is sealably slidable between the members within the space to separate the port from a detent chamber therein in which hydraulic fluid is contained. This, of course, equalizes the fluid pressure within the jar and well fluid in the annulus to facilitate raising and lowering of the jar within the well bore, as well as separating the hydraulic fluid from the well fluid to avoid contamination.

U.S. Pat. No. 4,109,736 shows several embodiments of a double acting hydraulic jar of this type, including one which has enjoyed considerable success in the industry. In this form of the jar, which is illustrated and described in connection with FIGS. 8 to 16, there are a pair of detent chambers each having a restriction formed on one member thereof and a pair of detent means each carried by the other member for movement through the restriction in one of the chambers. A balance chamber is disposed between and separated from each detent chamber by a piston ring sealably slidable between the members so that each detent means operates independently of and is unaffected by the other. More particularly, the detent means are so arranged with respect to one another and the restrictions that each may be "short cocked" in preparation for a subsequent jar.

Thus, with reference to the above mentioned figures of U.S. Pat. No. 4,109,736, assume that the tool has just delivered an upward jar following movement of the upper detent means out of the upper restriction. During this time, of course, the lower detent means has moved through the lower restriction without pressurizing the fluid in the lower hydraulic chamber due to the fact that its detent means is reversed with respect to the upper detent mechanism. If then another upward jar is to be delivered, the tool may be moved into a "short cocked" position by lowering the upper detent means in the restriction until the weight detector indicates that the lower detent means has begun to move into the lower restriction. Obviously, a reversal of this procedure permits the jar to be moved into a short cocked position following a down jar.

Also, each detent means of the jar of U.S. Pat. No. 4,109,736 is of simplified but reliable construction in which a detent ring carried by the inner tubular member has an outer diameter closely slidable within a restriction in the outer tubular member, and an inner diameter disposed about elongate slots or grooves on the inner member. More particularly, the detent ring is free to move longitudinally with respect to the inner member intermediate shoulders thereabout, and one or more metering pins extend with close tolerance through holes in the detent ring to engage at their opposite ends with the shoulders. As each ring moves into its restriction, one end thereof is seated upon a shoulder to prevent flow between it and the slots and thus retard movement of the inner member until the detent ring is moved out of the restriction. Despite these advantages, this jar is relatively long and expensive to manufacture because of its two detent chambers.

U.S. Pat. No. 4,456,081 discloses a double-acting, hydraulic jar in which detent means for imparting both up and down jars are contained within a single detent chamber having a single restriction through which the detent means are moved during an up or down jar. Moreover, the detent means are so constructed and arranged as to permit the jar to be "short cocked" preparatory to repeated up or down jars. That is, the detent means for retarding flow during an up jar is arranged beneath the detent means for retarding flow during a down jar so that following an up jar, it may be moved downwardly a short distance into the restriction before the detent means for retarding flow during a down jar enters the restriction. Conversely, following a down jar, the means for retarding flow during a down jar may be moved upwardly a short distance into the restriction ("short cocked") before the means for retarding flow during and up jar enters the restriction.

Although this theoretically permits the overall length of the jar to be shortened, at least as compared to the aforementioned jar shown in the above mentioned figures of U.S. Pat. No. 4,109,736, the detent means are of such construction as to be susceptible to considerable wear and malfunction. Thus, hydraulic fluid in the detent chamber must pass through spring biased check valves, as the detent means move through the restriction, and a portion of the tubular member on which the detent means are mounted forms seals with respect to the restriction as the adjacent detent means are moved therethrough.

It is therefore an object of this invention to provide a double-acting hydraulic jar in which the detent means are contained within a single detent chamber for movement through a single restriction, and so constructed and arranged as to permit "short cocking", but nevertheless of a construction which is less subject to wear and malfunction than are those of U.S. Pat. No. 4,456,081, and, more particularly, of a construction similar to that of the detent means of U.S. Pat. No. 4,109,736.

This and other objects are accomplished, in accordance with the illustrated and preferred embodiments of the invention, by a jar of the type described in which, as in the jar of U.S. Pat. No. 4,109,736, each of the detent ring means has flow limiting means therethrough and is carried by one member with one side adapted to move closely through a cylindrical restriction in a detent chamber in the other tubular member and the other side closely surrounding grooves in the one member and vertically reciprocable between positions seated on upper and lower shoulders on the one member to retard the flow of hydraulic fluid therepast as the tool is raised and lowered. However, as compared with the jar of U.S. Pat. No. 4,109,736, the jar of the present invention has only a single detent chamber with a single restriction formed therein, and the detent means is of such construction as to jar upwardly when pulled in one direction through the restriction and jar downwardly when pushed in the other direction through the restriction. Thus, the detent means includes a lower annular portion on its outer side which, when the detent means is seated on the lower shoulder, restricts flow therepast as it is pulled upwardly through the restriction, and an upper annular portion on its outer side which, when the detent means is on the upper shoulder, restricts flow therepast as it is pushed downwardly through the restriction. More particularly, the detent means includes means which connects its one side with its other side intermediate the annular portions so that the annular portion last to move out of the restriction is relatively freely movable back into the restriction until the other annular portion enters the restriction to permit the jar to be "short cocked" much in the manner of that of the jar of U.S. Pat. No. 4,456,081.

In accordance with one embodiment of the invention, the other tubular member has stops thereon intermediate the oppositely facing shoulders and the annular portions of said detent means comprise a pair of longitudinally spaced detent rings each being reciprocable between a shoulder and a stop and having a flow metering means extending through it. More particularly, the one side of each ring is connected to the other side thereof, when one end thereof is seated on a shoulder, by the space between its other end and the stop facing that shoulder.

In accordance with other embodiments of the invention, the detent means therein comprises a single detent ring having passageway means connecting the one side with the outer side thereof intermediate said annular portions. Thus, as will be more apparent from the description to follow, this embodiment of the jar is of even simpler construction and shorter than the first described embodiment, thus enabling the overall jar to be that much shorter.

The jar of U.S. Pat. No. 4,456,081 also includes a piston ring sealably reciprocable between the tubular members intermediate one end of the detent chamber and a port fluidly communicating with the annulus, whereby the pressure of the hydraulic fluid equals that of the well fluid. More particularly, the piston ring is located at the lower end of the detent chamber, so that, during movement of the upper detent means through the restriction during a downward jar, the ring is forced downwardly against a stop by the high pressure of hydraulic fluid in the detent chamber. Inevitably, this results in a gradual loss of hydraulic fluid from the detent chamber due to leakage past the ring, so that the ring will over time assume positions above the lower limit shoulder and thus shorten the travel of the detent means during a down jar.

It is therefore another object of this invention to provide a double-acting hydraulic jar in which the detent means are movable through a single restriction in a single detent chamber, but in which there is a minimum of loss of hydraulic fluid past a piston ring as the detent moves in a direction toward the piston ring.

This and other objects are accomplished, in accordance with the present invention, by a jar of the type described in which the one member in which the grooves are formed is sealably engaged with other member in which the restriction is formed for closing the chamber intermediate the detent ring means and the piston ring, and a longitudinal passageway is formed through the chamber closing means to connect the chamber above and below it. More particularly, a valve member is movable between positions opening and closing the passageway, and spring means urges the valve member to open position with a force less than that developed by the hydraulic fluid during movement of the detent ring means through the restriction in a direction toward the valve member. Thus, the passageway is normally open to insure that the pressure of the hydraulic fluid is equal to that in the annulus of the well bore, but closed during a jarring stroke which might otherwise cause leakage of hydraulic fluid.

In the drawings, wherein like reference characters are used throughout to designate like parts:

Figure 1A:
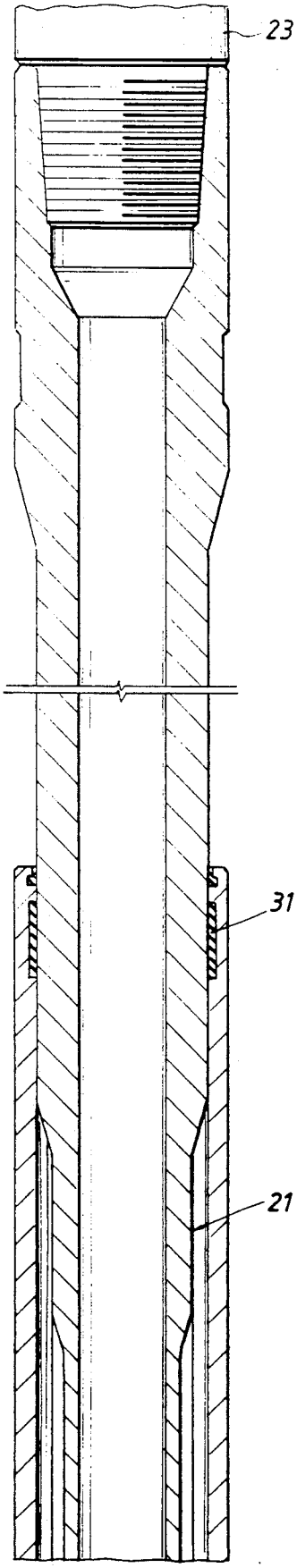
FIGS. 1A, 1B, 1C and 1D are upper, intermediate and lower vertical sectional views of a jar constructed in accordance with the first described embodiment of the present invention, and showing the detent means thereof in a position above the restriction in the detent chamber, which it may occupy when the jar is run into the well bore prior to a jarring stroke.
Figure 1B:
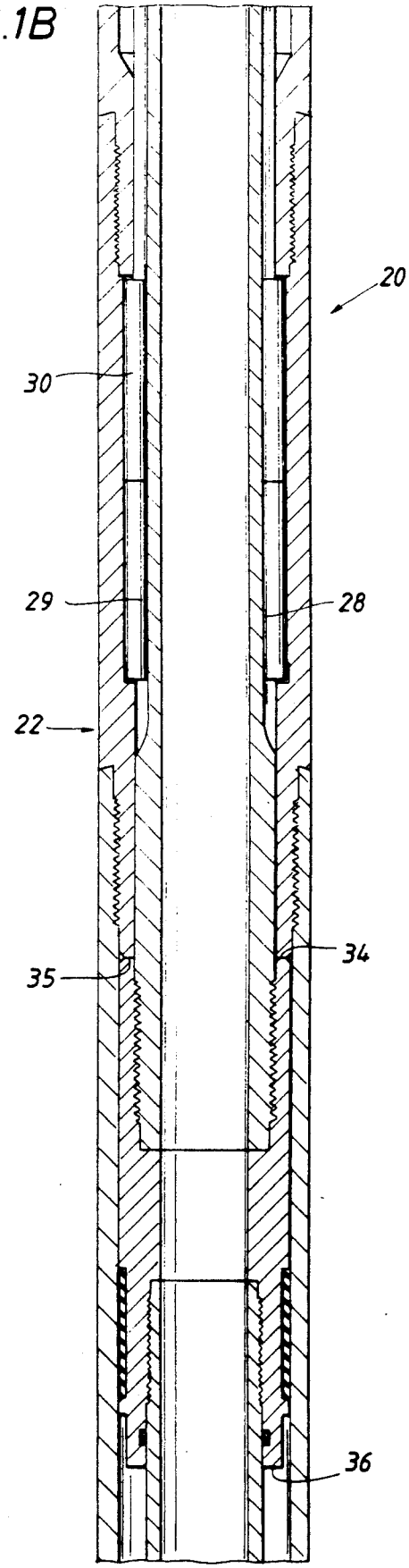
Figure 1C:
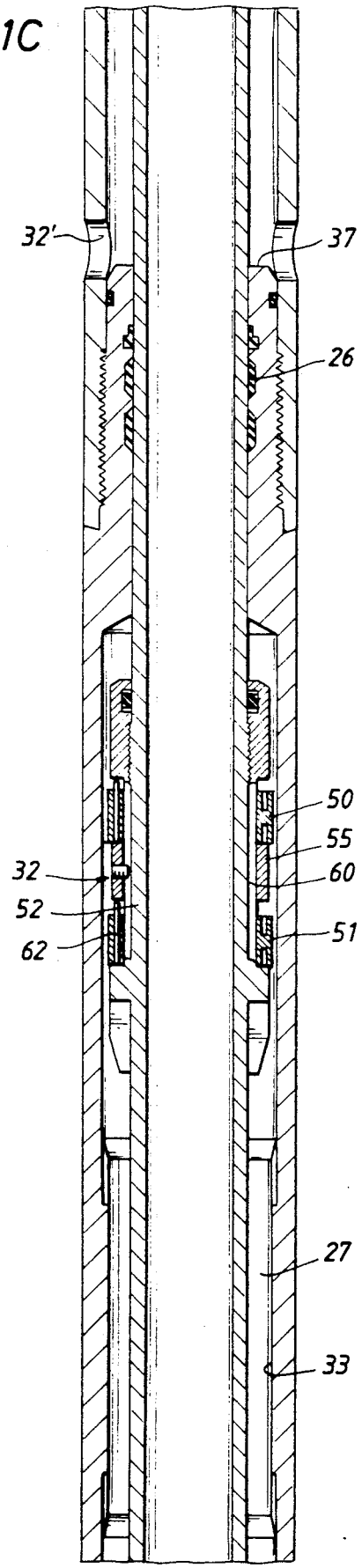
Figure 1D:
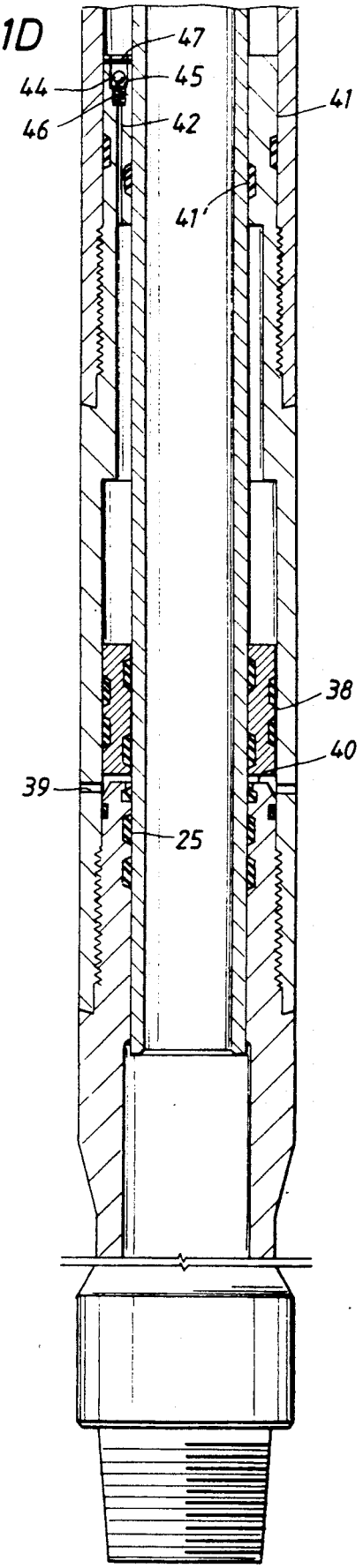

FIGS. 10 and 11 are vertical sectional views of a portion of a jar having a somewhat different single detent ring constructed in accordance with still another embodiment of the invention, with the ring being shown in FIG. 10, just prior t o movement of its lower annular portion upwardly into the restriction in the outer member, during an up jar, and in FIG. 11 just prior to movement of the upper annular portion downwardly into the restriction during a down jar; and FIG. 11 is a perspective view of the detent ring removed from about the inner member.

With reference now to the details of the above described drawings, the jar which is illustrated in FIGS. 1A-1D, 2A-2B, 3A-3B, 4, 5 and 6, and indicated in its entirety by reference character 20, comprises telescopically arranged, inner and outer tubular members 21 and 22, respectively. The inner member 21 has a box at its upper end for connection to the lower end of a tubing string 23, and the outer member has a pin at its lower end for connection to the box of a tubular object stuck in the well bore and adapted to be jarred loose by operation of the jar in the manner described to follow. Each of the tubular members is made up of threadedly connected tubular sections, with the lower end of the inner member being slidably reciprocable within packing 25 carried within a lower portion of the outer tubular member and an intermediate portion of the inner tubular member being sealably slidably received within packing 26 carried by an intermediate portion of the outer tubular member. The packings 25 and 26 are of equal diameter so as to define an annular space between the enlarged inner diameter of the outer tubular member intermediate the packings and the outer diameter of the inner tubular member having a detent chamber 27 filled with a suitable hydraulic fluid which is essentially non-compressible.

The upper portions of the tubular members above the upper packing 26 are provided with oppositely facing grooves 28 and 29 respectively which receive splines 30 held at their opposite ends between oppositely facing shoulders on the inner diameter of the outer tubular member, thus causing the tubular members to rotate with one another. Packing 31 is carried by the inner diameter of the upper end of the outer tubular member to protect the annular space in which the splines are disposed from debris which might otherwise accumulate therein. Ports 32' formed in the outer tubular member above packing 26 vent this annular space to the annulus of the well bore surrounding the jar so as to prevent a fluid lock as the inner and outer tubular members are vertically reciprocated with respect to one another.

As well known in the art, the tool is adapted to be raised and lowered within the well bore by means of the tubing string 23 from which the upper end of the jar is suspended. The spline connection between the tubular members permits torque to be applied to the jar in order to make up the pin at its lower end with the object stuck in the hole.

A detent means, indicated in its entirety by reference character 32 is carried about an intermediate portion of the inner tubular member for disposal within the detent chamber 27. The inner diameter of the outer tubular member intermediate the upper and lower ends of the detent chamber has a reduced diameter cylindrical surface providing a restriction 33 through which the detent means 32 is adapted to be moved in order to place the upper tubular member in the tubing string from which it is suspended in compression during a down jar or in tension during an up jar.

When the detent means has been moved upwardly out of the restriction, tension in the tubing spring causes an upwardly facing shoulder 34 about the inner tubular member to move rapidly upwardly to engage a downwardly facing shoulder 35 on the outer tubular member to impart an upward jar, and when the detent means has been moved downwardly out of the restriction, compression in the tubing string above the jar causes a downwardly facing shoulder 36 about the inner tubular member to move rapidly downwardly to engage an upwardly facing shoulder 37 on the outer tubular member to impart a downward jar thereto. As previously noted, in the position shown in FIGS. 1A to 1D, the detent means 32 is in an upper portion of the detent chamber above the restriction 33 which it would occupy following an upward jar or preparatory to applying a downward jar. In this position, the jar may be said to be "open".

A piston 38 is disposed within the lower end of the detent chamber and carries packing about its inner and outer diameters for slidably engaging the outer diameter of the inner member and the inner diameter of the outer member above ports 39 formed in the outer member to connect with the detent chamber above the packing 25, thus equalizing fluid pressure within the detent chamber with the pressure of well fluid in the annulus about the jar. As shown, the hydrostatic pressure of the well fluid has caused the piston to be raised slightly above an upwardly facing shoulder 40 on the lower end of the outer tubular member which limits downward movement of the piston 38.

The outer tubular member has a reduced inner diameter portion 41 which carries packing 41' about its inner diameter in which the inner tubular member is sealably slidable, and passageway 42 extends through the portion 4 to the detent chamber above and below the annular closure provided by the reduced diameter portion. This passageway is adapted to be opened and closed by means of a ball type valve member 44 disposed above a seat 45 about the upper end of the passageway, and the ball 44 is urged upwardly to an open position above the seat 45 by means of a coil spring 46 acting between it and an upwardly facing shoulder within the passageway 42. The ball is retained in a position above the seat by means of a pin 47 extending across the enlarged upper end of the passageway 42 in which the ball is disposed. As previously mentioned, and as will be described in detail to follow, the passageway is thus open except during a downward jarring stroke.

The detent means comprises upper and lower detent rings 50 and 51 closely slidable about a reduced outer diameter portion 52 of the inner tubular member and intermediate downwardly and upwardly facing shoulders 53 and 54 formed on the inner tubular member at the upper and lower ends, respectively, of the reduced diameter portion 52. A ring 55 is mounted on the inner tubular member by means of a set screw 56 intermediate the upper and lower detent rings 50 and 51 so that each of the detent rings is free for limited vertical reciprocation with respect to the inner tubular member between the shoulders and stops 57 and 58 provided at the upper and lower ends of the ring 55.

Vertically extending grooves 60 are formed in the reduced diameter portion 52 and are of such length so as to connect with the reduced diameter portion 52 at their upper ends when the upper seat ring 50 is in its lower position on the stop 58, and to connect at their lower ends with the reduced diameter portion 52 when the lower detent ring 51 is in its upper position engaged with the stop 57. However, when the upper ring 50 is in its upper position engaged with the shoulder 53, it prevents flow between the grooves and the reduced diameter portion, and when the lower detent ring is in its lower position on the shoulder 54, it prevents flow between the grooves and the reduced diameter portion 52 above the lower detent ring.

Figure 2A:
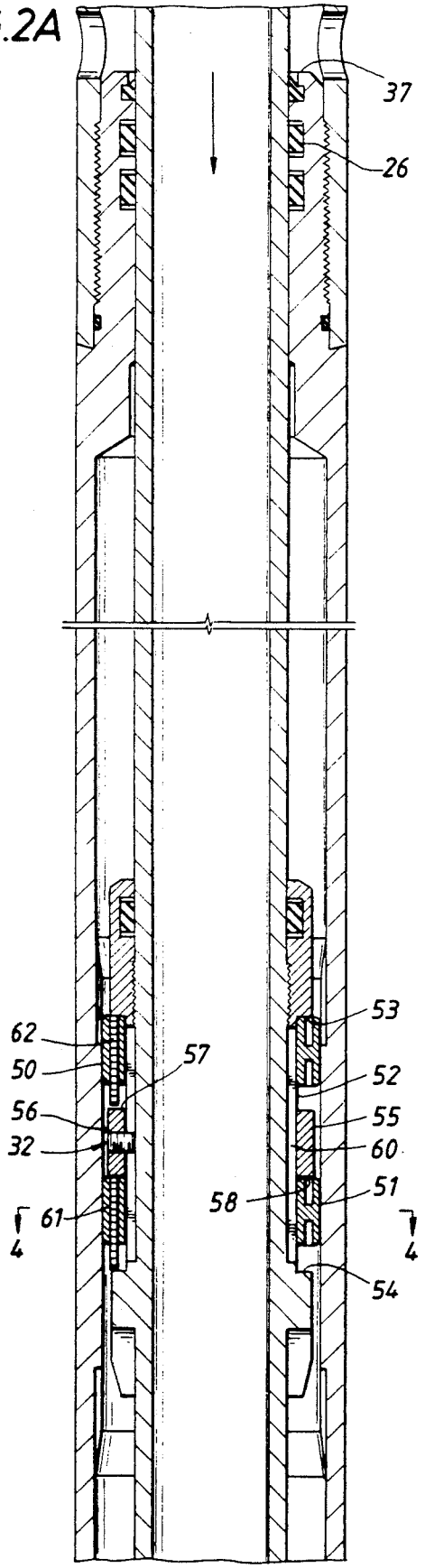
FIGS. 2A and 2B are additional, somewhat enlarged vertical sectional views of upper and lower intermediate portions of the jar of FIGS. 1A to 1D, but upon lowering of the detent means into the restriction in order to initiate a downward jar.
Figure 2B:
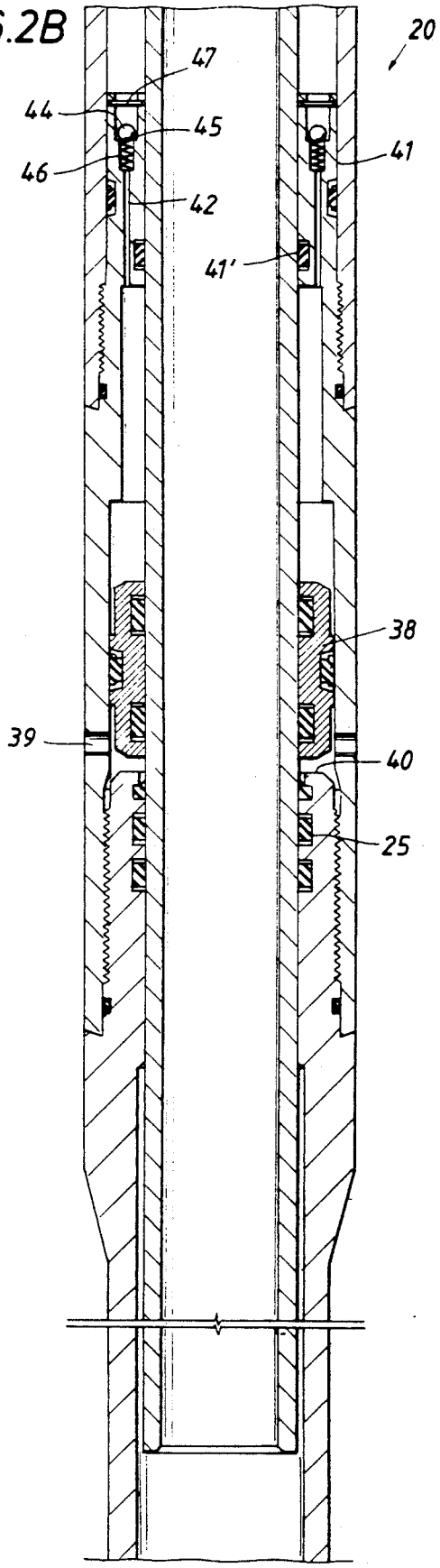
Figure 3A:
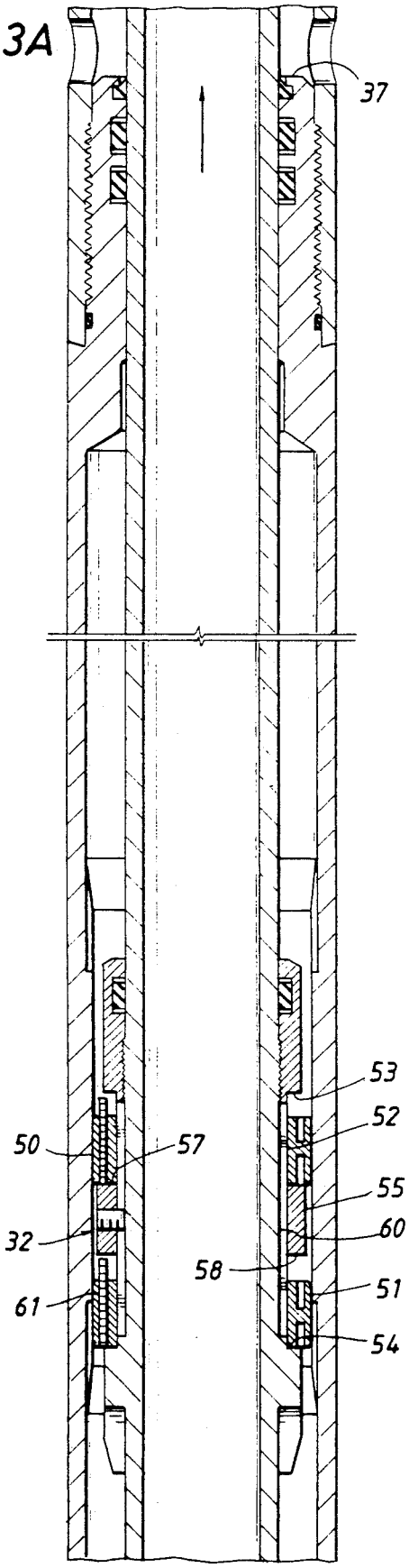
FIGS. 3A and 3B are vertical sectional views similar to FIGS. 2A and 2B, but during raising of the detent means of the jar through the restriction in order to initiate an upward jar.
Figure 3B:
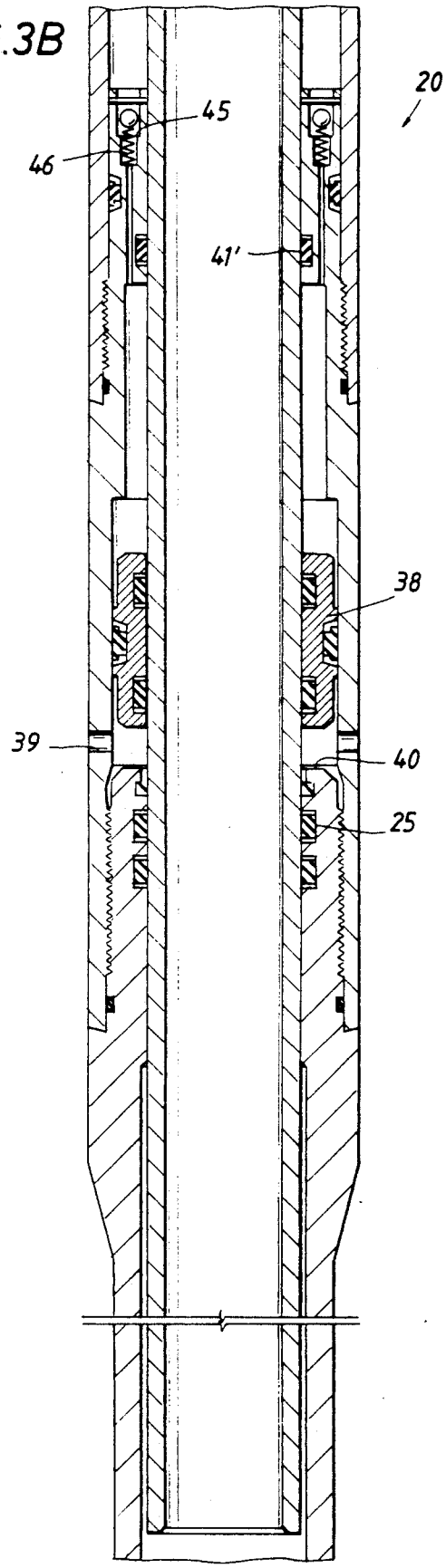

The detent rings are of the same construction as the detent rings shown in aforementioned U.S. Pat. No. 4,109,736 in that, as previously noted, each has fluid metering means which restricts flow therepast when the detent ring is seated on its respective shoulder at one end of the reduced diameter portion 52 of the inner tubular member as it moves through restriction 33. For this purpose, each such ring has a vertical passageway 61 therethrough and a metering pin 62 extending closely through the metering passageway and engageable at its opposite ends with the oppositely facing stops on the ring 55 and the shoulder on which the detent ring is adapted to seat. Thus, when the upper seat ring 50 is seated upon upper shoulder 53 during movement into the restriction during a downward jarring stroke, as shown in FIG. 2A, substantially all of the flow of hydraulic fluid past the detent ring must flow through the small clearance between the metering pin in the detent ring 50 and its passageway. On the other hand, as the lower detent ring 51 is seated on lower shoulder 54 as it is pulled upwardly through the restriction, the only substantial flow of hydraulic fluid therepast is between its metering pin and passageway.

However, during a downward jarring stroke, as illustrated in FIG. 2A, the lower detent ring 51 has been moved upwardly to engage with the lower stop 58 on the ring 55 so as to open the lower ends of the grooves or slots 60 to the upper ends of the slots above detent ring 50 to permit hydraulic fluid in the detent chamber to freely flow therethrough and thus permit the lower detent ring 51 to move into and through the restriction with relative ease until the lower end of the upper detent ring 50 moves into the restriction. Conversely, during an upward jarring stroke, the upper detent ring 50 is seated upon the upper stop 57 of the ring 55 to open the upper ends of the slots to the restricted portion 52 between the lower detent ring and the lower stop 58 until such time that the upper end of the lower detent ring begins to move into the restriction, and even though the lower detent ring is seated upon the shoulder 54 to close the connection of the lower ends of the slots to the detent chamber below the lower detent ring.

As previously mentioned, and as will be more fully understood from the foregoing description, this construction of the detent mechanism 32 enables the jar to be "short cocked" following either an upward or a downward jar. Thus, for example, assuming that the jar has just imparted an upward jar, the inner tubular member may be lowered from the position of FIGS. 1A to 1D to move the lower detent ring into the restriction 33. Until such time that the upper detent ring begins to move into the restriction, there is little resistance to lowering of the inner tubular member for this purpose. Then, as the lower end of the upper detent ring begins to move into the restriction, and flow therepast is restricted to passage through the metering means in the upper detent ring, the operator of the jar notes from the weight indicator that it has reached this position and may continue to lower the inner tubular member a relatively short distance and thus into a position in which the jar is "short cocked" for another upward jar.

Likewise, upon completion of a downward jar where in the detent means has moved beneath the restriction 33, the inner tubular may be raised to move the upper detent ring into the restriction 33 with little resistance since the hydraulic fluid in the detent chamber is free to pass through the upper ends of the slots above the upper detent ring seated on the upper stop of the ring 55. Then, the operator senses movement of the upper end of the lower detent ring by observing the weight indicator, and thus can continue to raise the inner tubular member only the distance required to bring the jar into a "short cocked" position for a subsequent downward jar.

Raising of the upper inner tubular member during an upward jar has no effect on the piston ring 38 and the normally open ball valve member 47. Thus, the compressed hydraulic fluid in the detent chamber above the detent means is contained by the upper packing 26 so that little or no loss of the hydraulic fluid is contemplated. However, during lowering of the inner tubular member for the purpose of imparting a downward jar, any loss of hydraulic fluid past the piston 38 would permit the piston to assume a position closer to the stop on the outer tubular member above stop 40 and thus limit the extent of a down jar which could be imparted to the jar.

However, as previously described, and in accordance with another novel aspect of the present invention, the spring 46 normally holds the ball 44 unseated with a force less than that developed by the hydraulic fluid in the detent chamber during downward movement of the detent mechanism through the restriction. Consequently, during only the downstroke of the jar, the normally open ball will move downwardly to seat and thus close the passageway, and thereby minimize the loss of hydraulic fluid from the detent chamber which might otherwise occur past the piston 38.

Figure 4:
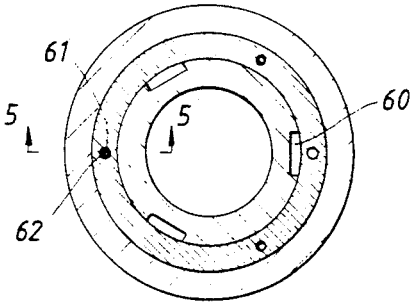
FIG. 4 is a cross-sectional view of the above described jar, as seen along broken lines 4—4 of FIG. 2A.

As best shown in FIG. 4, there are a plurality of slots 60 formed in the reduced diameter portion 52 of the inner tubular member, preferably in equally spaced apart relation. Also, as shown in that figure as well as in the previously described figures, stress holes may be formed in the upper and lower ends of the detent ring, preferably opposite the metering passageway therethrough.

Figure 5:
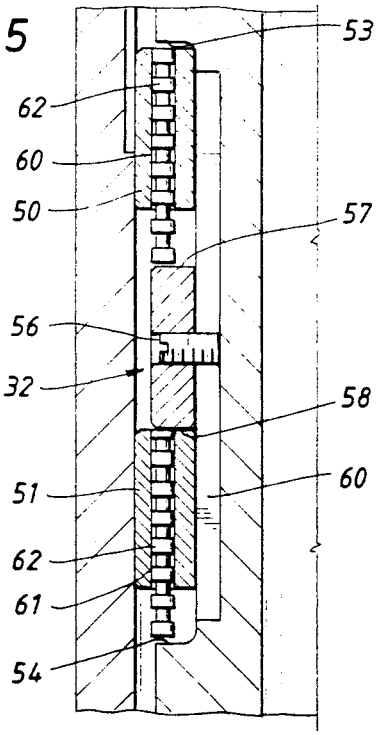
FIG. 5 is an enlarged vertical sectional view of the detent means as it moves downwardly into the restriction of the jar, as shown in FIG. 2A, and as seen along broken lines 5—5 of FIG. 4.
Figure 6:
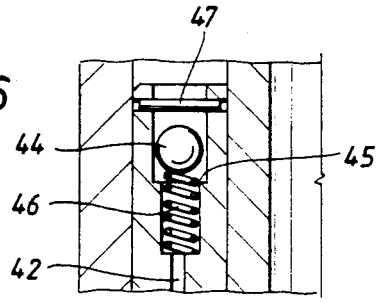
FIG. 6 is an enlarged vertical, sectional view of the valve member for controlling the passageway above a lower piston ring in the detent chamber in the position it occupies in FIG. 1D.

As shown in the detailed illustration of FIG. 5, the metering pin may be provided with grooves in which debris may accumulate as the detent ring is reciprocated vertically along the length of the metering pin. Thus, any such debris which might otherwise interfere with the free movement of the detent ring along the meter pin is relieved as the recess reaches the end of the metering passageway, whether during upward or downward reciprocation of the detent ring with respect thereto.

The embodiment of the jar illustrated in FIGS. 7A, 7B, 8 and 9 is of essentially the same construction as the above described jar 20, except insofar as the construction of the detent means is concerned and the manner in which pressure of the hydraulic fluid within the detent chamber is equalized with respect to that of well fluid in the annulus in the well bore about the jar. Thus, this jar and its parts which correspond to those of the jar 20 are indicated by the same reference characters but with the addition of the suffix "A". For example, this embodiment of the jar, which is indicated in its entirety by reference character 20A, includes inner and outer telescopically arranged tubular members 21A and 22A, the upper end of the inner tubular member 21A being connectible to the lower end of the tubing string and the lower end of the outer tubular member 22A being connectible to the objects stuck in the well bore.

The lower end of the inner tubular member is sealably slidable within packing 25A carried within the lower portion of the outer tubular member to close the lower end of the detent chamber 27A, while the upper end of the detent chamber is closed by means of a piston 70 having seal rings about its inner and outer diameter for slidably engaging about an intermediate portion of the inner tubular member and the inner diameter of the outer tubular member. The inner packing of the piston 70 seals about a portion of the inner tubular member equal to the diameter of that which is sealably slidable within packings 25A, thus preventing fluid lock within the detent chamber 27A.

The piston 70 is engageable in its uppermost position with a downwardly facing shoulder 71 on the outer tubular member, and ports 72 are formed in the outer tubular member to connect with the inner diameter thereof above the outer packing on the piston 70. Similarly, a piston 73 carries seal rings about its inner and outer diameters for sealably sliding with respect to the inner and outer tubular members at the lower end of a detent chamber 27A above an upwardly facing shoulder 74 of the outer tubular member to locate it in the position in which the outer packing about piston 73 is above ports 75. Thus, the pressure of hydraulic fluid in the detent chamber equals that of well fluid about the jar to prevent fluid lock.

Figure 7A:
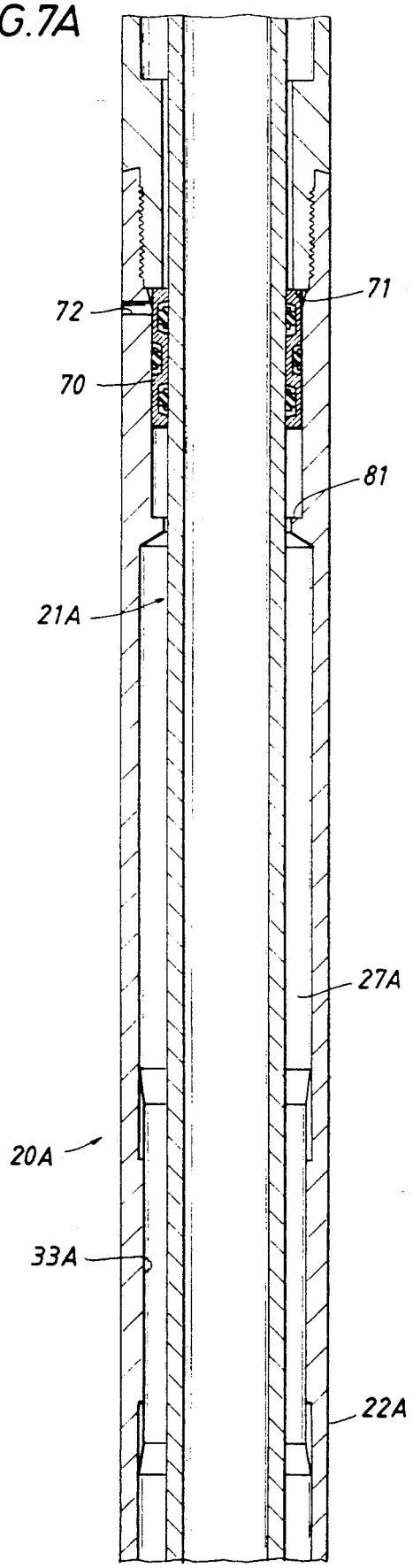
FIGS. 7A and 7B are vertical sectional views of a portion of a jar having a single detent ring constructed in accordance with another embodiment of the present invention, and showing the detent ring in a position within the detent chamber below the restriction, as it might occupy following a down jar or prior to initiating an up jar.
Figure 7B:
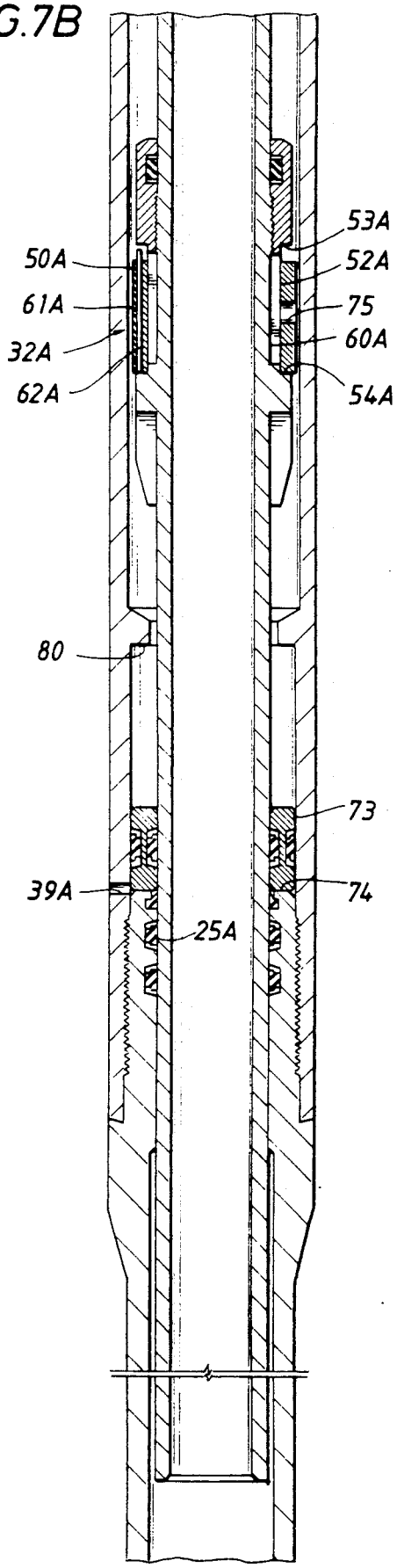

The detent means 32A carried about the inner tubular member for disposal within the detent chamber 27A comprises a single detent ring 50A having an outer diameter which is adapted to be fit closely within a restriction 33A formed by a reduced diameter cylindrical portion within the outer tubular member intermediate the upper and lower ends of the detent chamber. More particularly, the detent ring is disposed about a reduced diameter portion 52A of the inner tubular member vertically intermediate upper and lower downwardly and upwardly facing shoulders 53A and 54A, respectively, of the inner tubular member which are spaced apart a distance to permit the detent ring to reciprocate with respect to the inner tubular member. Also, and as in the case of the detent means described in the previous embodiment of the invention, slots 60A are formed in the reduced diameter portion of the inner tubular member to connect at their upper ends with the reduced diameter portion when the detent ring is in its lower position, as shown in FIG. 7B, and to connect at their lower ends with the reduced diameter portion when the detent ring is in its upper position seated on shoulder 53A. Additionally, one or more metering pins 62A extend closely through passageways 61A formed through the detent ring 50A are adapted to engage with the shoulders 53 and 54A.

Figure 8:
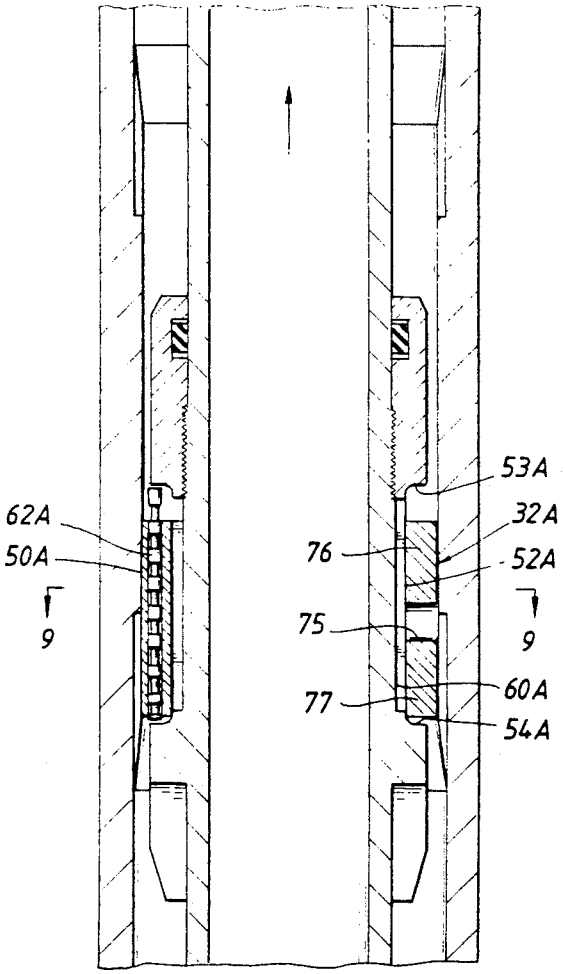
FIG. 8 is an enlarged vertical sectional view of the detent ring of the jar of FIGS. 7A and 7B, but raised to a position in which it is moved into the restriction to initiate an upward jar.

In this embodiment of the invention, the detent ring has several holes 75 formed therethrough to connect the inner and outer diameters of the detent ring during all positions of the detent ring in the reduced diameter portion 52A of the inner tubular member. Consequently, in the event the jar is to be moved upwardly, and the inner tubular member raised for this purpose, the detent ring will initially seat upon shoulder 54A, as shown in FIGS. 7B and 8. As the upper annular portion 76 of the detent ring above the holes 75 moves into the restriction 33A, hydraulic fluid will be free to pass into the upper ends of the slots 60A and out the holes 75 even though the lower end of the detent ring is seated upon the shoulder 54A, thus disconnecting the lower ends of the slots with the detent chamber. Thus, the detent mechanism moves freely into the restriction until the upper end of the lower annular portion 77 of the detent ring begins to move into the restriction as shown in FIG. 8. At this time, the operator is able to detect the beginning of the jarring stroke by observing the weight indicator at the well surface. In the event a full upward jar is to be imposed, the inner tubular member continues to be moved upwardly through the restriction, following which movement of the detent ring out of the restriction permits tension in the inner tubular member to apply an upward jar, as described in accordance with the first embodiment.

Conversely, downward movement of the detent ring through the restriction imparts compression to the inner tubular member which will move the inner tubular member rapidly downwardly in a jarring stroke. If it is then desired to impart another downward jar, the inner tubular member may be moved upwardly to "short cock" the jar. For this purpose, the inner tubular member is raised upwardly to the position of FIG. 8 where, as previously noted, the operator observes a change in the weight indicator. The inner tubular member may then be moved upwardly a desired amount in order to "short cock" the jar in preparation for the subsequent downward stroke. In any case, during initial upward movement of the inner tubular member for this purpose, the detent ring has moved relatively freely through the restriction due to the passage of hydraulic fluid through the holes 75 and the upper ends of the slots past the upper end of the detent ring which is spaced below the shoulder 53A.

Figure 9:
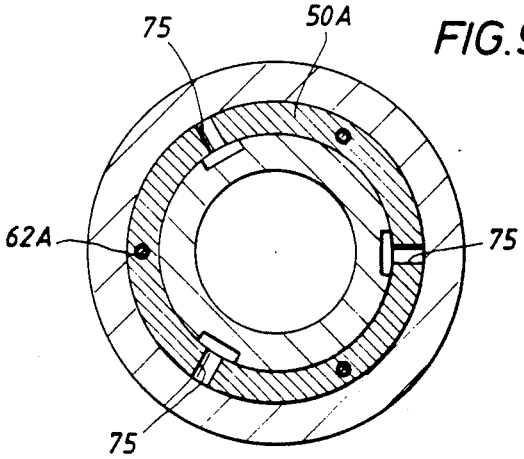
FIG. 9 is a cross-sectional view of the jar and detent mechanism of FIG. 8 as seen along broken lines 9—9 of FIG. 8.

As shown in FIG. 9, a number of slots 60A may be formed within the restricted portion 52A of the inner tubular member. In addition, there may be several holes 75, each of which is preferably a somewhat elongated slot.

As previously indicated in accordance with the first described embodiment, the gradual loss of hydraulic fluid past the pistons 70 and 73 will permit the upper piston 70 to assume a lower position than that shown and the lower piston 73 to assume a more upwardly position than that shown, which of course will shorten the effective stroke of the jar in either an upward or downward direction. A downwardly facing shoulder 80 is formed on the inner diameter of the outer tubular member above the piston 73 to define a volume in the annular chamber between it and the upper end of the piston in its seated position which is less than the volume within the restriction 33A. In like manner, an upwardly facing shoulder 81 is formed on the inner diameter of the outer tubular member below the piston 70 so as to limit its downward movement. More particularly, shoulder 81 is so located relative to the lower end of the piston as to define a volume which is less than that of the volume within the restriction 33A. Consequently, it is impossible for either piston to reach a position in which no jar whatsoever would be imparted.

The embodiment of the jar shown in FIGS. 10–12 may be of basically the same construction as the jar 20A except in so far as the construction of the detent ring is concerned. Thus, the parts of the jar which correspond to those of the jar 20A are indicated by the same reference characters but with the suffix "B" rather than the "A". Thus, for example, this embodiment of the jar, which is indicated in its entirety by reference character 20B, includes inner and outer telescopically arranged tubular members 21B and 22B, with the upper end of the inner tubular member being connectible to the lower end of the tubing string and the lower end of the outer tubular member being connectible to the objects stuck in the wellbore. As in the case of the prior described jar 20A, the lower end of the inner tubular member is adapted to be sealably slidable within packing carried within the lower portion of the outer tubular member to close the lower end of a detent chamber 27B, a portion of which is shown in FIGS. 10 and 11, and the upper end of the detent chamber is adapted to be closed by a piston ring slidably engaging between the inner and outer tubular members. Furthermore, and again as described in connection with the prior embodiment of the invention, the pressure of hydraulic fluid in the detent chamber is equal to that of the well fluid about the jar so as to prevent fluidlock. Also, suitable shoulders are formed on the inner and outer tubular members to permit the application of up and down jars as the detent means to be described is pulled through the restriction in the detent chamber.

Detent means 32B carried about the inner tubular member for disposal within the detent chamber 27B comprises a single detent ring 50B having an outer diameter which is adapted to fit closely within restriction 33B formed by reduced diameter cylindrical portion within the outer tubular member, intermediate the upper and lower ends of the detent chamber. More particularly, the detent ring is disposed about a reduced diameter portion of 52B of the inner tubular member vertically intermediate upper and lower, downwardly and upwardly facing shoulders 53B and 54B respectively on the inner tubular member, which shoulders are spaced apart a distance to permit the detent ring 50B to reciprocate with respect to the inner tubular member.

As in the case of the detent means of the previously described embodiments of the invention, slot 60B are formed in the reduced inner diameter of the inner tubular member to connect at their upper ends with the reduced diameter position when the detent ring is in its lower position seated above shoulder 54B, as shown in FIG. 10, and to connect at their lower ends with the reduced diameter portion when the detent ring is in its upper position seated below shoulder 53B, as shown in FIG. 11. Additionally, one or more metering pins (not shown) are adapted to extend closely through passageway 61B (see FIG. 12) formed through the detent ring 50B and are adapted to engage at their opposite ends with the shoulders 53B and 54B.

In this embodiment of the invention, the detent ring also has passageway means formed therethrough to connect its inner and outer diameters during all of its positions within the reduced diameter portion of the tubular member. Thus, as shown, grooves 78 and 79 are formed in the outer side of the ring and extend longitudinally thereof between uninterrupted annular portions at the upper and lower ends of the ring, and holes 80 connect the upper ends of the grooves 78 with the inside of the ring, while holes 81 connect the lower end of the grooves 79 with the inner side of the detent ring.

In the event that the jar is to be moved upwardly either for the purpose of imparting an upward jar to the tool or "short cocking" it for a subsequent downward jar, the inner tubular member is raised so as to cause the detent ring to seat upon shoulder 54B, as shown in FIG. 10. As the upper annular portion of the ring moves into the restriction 33B in the outer tubular member, hydraulic fluid is free to flow through the slots 60B, the holes 80 and through grooves 78 even though the lower end of the detent ring is seated upon the shoulder 54B. Thus, the detent ring moves freely into the restriction until the upper end of the lower annular portion of the detent ring begins to move into the restriction, as shown in FIG. 10. As described in connection with the previous embodiment of the jar, the operator is then able to detect the beginning of the jarring stroke by observing the weight indicator at the well surface. In the event a full upward jar is to be imposed, the inner tubular member continues to be raised upwardly through the restriction, following which movement of the lower annular portion out of the restriction permits tension in the inner tubular member to apply an upward jar.

On the other hand, downward movement of the detent ring 50B through the restriction imparts compression of the inner tubular member which will move the inner tubular member rapidly downwardly in a jarring stroke. In this case, as shown in FIG. 11, the detent ring 50B is moved upwardly to seat upon shoulder 53B, but hydraulic fluid is free to flow through the slot 60B in the reduced diameter portion of the inner tubular member, the holes 81 and grooves 79. Thus, the detent ring is free to move freely into the restriction until the upper annular portion of the detent ring begins to move into the restriction, as shown in FIG. 11. Thus, the operator is then able to detect the beginning of the jarring stroke by observing the weight indicator at the well surface. In the event, a full downward jar is to be imposed, the inner tubular member continues to be moved downwardly through the restriction, following which movement of the detent ring out of the restriction permits compression in the inner tubular to apply a downward jar.

As previously described in connection with other of the invention, the inner tubular member may be raised or lowered, following movement of the detent chamber through the restriction in either direction to "short cock" the tool for a subsequent up or down jar. In view of this prior description, further description is not believed necessary at this point.

As previously described, the detent means of the above described embodiments of the invention is of considerably simpler construction than the detent means of the prior embodiment of the jar, not only because it requires only one detent ring, but also a shorter restriction in the outer tubular member and thus an inner tubular member of less length.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A hydraulic jar for use in applying up and down jars to an object stuck in a well bore, comprising first and second telescopically arranged, tubular members connectible, respectively, to the stuck object and a pipe string adapted to be raised and lowered within the well bore, and being circumferentially spaced apart and sealed with respect to one another along equal diameter portions to form an annular space therebetween, the outer member having a port therein to connect one end of the space with the well bore, a piston ring sealably slidable within the space to separate the port from a chamber within the space which contains hydraulic fluid, one of the tubular members having a cylindrical restriction within the chamber and the other tubular member having longitudinal grooves formed within a reduced diameter portion about its circumference intermediate longitudinally spaced upper and lower shoulders, and detent ring means carried by the other member within the reduced diameter portion with one side closely surrounding the grooves and vertically reciprocable with respect to said other member between a first position in which its lower end is seated on the lower shoulder of the other member to prevent flow therepast, as a lower annular portion of its other side is pulled upwardly through the restriction, and a second position in which its upper end is seated on the upper shoulder of said other member to prevent flow therepast, as an upper annular portion of its other side is pushed downwardly through the restriction, said detent ring means having metering means which permit limited flow therethrough as said annular portions move through said restriction and means connecting its one side with its other side intermediate said annular portions so that the annular portion last to move out of the restriction is relatively freely movable back into the restriction until the other annular portion enters the restriction, and said tubular members having means arranged to engage for imparting an up jar to the stuck object as the lower annular portion of the detent ring means is pulled upwardly out of the restriction and a down jar thereto as the upper annular portion of the detent ring means is pushed downwardly out of the restriction.

2. A hydraulic jar of the character defined in claim 1, wherein said other member has stops thereon intermediate and facing the shoulders, the annular portions of said detent means comprise a pair of longitudinally spaced detent rings each being reciprocable between a shoulder and a stop, and the one side of each ring being connected to the other side thereof, when one end thereof is seated on a shoulder, by the space between its other end and the stop facing that shoulder.

3. A hydraulic jar of the character defined in claim 2, wherein the metering means comprises a pin extending with close clearance through a hole in the ring.

4. A hydraulic jar of the character defined in claim 1, wherein the detent means comprises a single detent ring having passageway means therein connecting the one side with the outer side thereof intermediate said annular portions.

5. A hydraulic jar of the character defined in claim 4, wherein the passageway means comprises a hole extending through the detent ring to connect its opposite sides.

6. A hydraulic jar of the character defined in claim 4, wherein the passageway means comprises first and second grooves formed in the outer side of the ring and extending longitudinally between said annular portions, and a first hole connecting the end of the first groove adjacent one annular portion with the inner side of the ring and a second hole connecting the end of the second groove adjacent the other annular portion with the inner side of the ring.

7. a hydraulic jar of the character defined in claim 4, wherein the metering means comprises a pin extending with close tolerance through a hole in the ring.

8. A hydraulic jar of the character defined in claim 1, wherein the outer member has a second port therein to connect the other end of the space with the well bore, another piston ring is sealably slidable within the space to separate the second port from the chamber, and the one member has stops to limit the volume of hydraulic fluid displacable by each piston to less than that displaced by the detent means in sliding through the restriction.

9. A hydraulic jar of the character defined in claim 1, including means on the other member sealably engaging the one member for closing the chamber intermediate the detent ring means and the piston ring, means forming a longitudinal passageway through the chamber closing means, a valve member movable between positions opening and closing the passageway, and spring means urging the valve member to open position with a force less than that developed by the hydraulic fluid during movement of the detent ring means through the restriction in a direction toward the valve member.

10. A hydraulic jar of the character defined in claim 1, wherein the cylindrical restriction is on the inner diameter of the outer member, and the detent ring means is carried by the inner member.

11. A hydraulic jar for use in applying up and down jars to an object stuck in a well bore, comprising first and second telescopically arranged tubular members connectible, respectively, to the stuck object and a pipe string adapted to be raised and lowered within the well bore, and being circumferentially spaced apart and sealed with respect to one another along equal diameter portions to form an annular space therebetween, the outer member having a port therein to connect one end of the space with the well bore, a piston ring sealably slidable within the space to separate the port from a chamber within the space which contains hydraulic fluid, one of said tubular members having a cylindrical restriction within the chamber and the other tubular member having longitudinal grooves formed about its circumference intermediate longitudinally spaced shoulders, detent means carried by the other member with one side surrounding the grooves and the other side being closely slidable within the restriction to retard the flow of hydraulic fluid therepast and thus stretch the pipe string, as the second member is raised, and being closely slidable within the restriction to retard the flow of hydraulic fluid therepast, and thus compress the pipe string, as the second member is lowered, said members having oppositely facing shoulders arranged to engage for imparting an up jar to the stuck object as the detent ring means is pulled upwardly out of the restriction and a down jar thereto as the detent ring means is pushed downwardly out of the restriction, means on the other member sealably engaging the one member for closing the chamber intermediate the detent ring means and the piston ring, means forming a longitudinal passageway through the chamber closing means, a valve member movable between positions opening and closing the passageway, and spring means urging the valve member to open position with a force less than that developed by the hydraulic fluid during movement of the detent ring means through the restriction in a direction toward the valve member.

* * * * *